US005419447A

United States Patent [19]

Lim

[11] Patent Number: 5,419,447

[45] Date of Patent: May 30, 1995

[54] BABY BOTTLE

[76] Inventor: Pak P. Lim, No. 29, Lengkok Mansion, Mansion Park off Kampar Road, Perak, Malaysia, 30250 Ipoh

[21] Appl. No.: 260,411

[22] Filed: Jun. 14, 1994

[30] Foreign Application Priority Data

Dec. 14, 1993 [GB] United Kingdom ..... 2035831

[51] Int. Cl.[6] ..... A61J 9/00

[52] U.S. Cl. ..... 215/398; 215/11.1; D9/310

[58] Field of Search ..... 215/11.1, 11.6, 11.3, 215/11.4, 100 A; D9/310, 311, 530, 531, 533, 535, 536

[56] References Cited

U.S. PATENT DOCUMENTS

| | | | |
|---|---|---|---|
| D. 192,390 | 3/1962 | De Kolb | D9/310 |
| 3,443,710 | 5/1969 | Hills | 215/100 A X |
| 4,750,630 | 6/1988 | Campbell et al. | 215/11.1 |
| 4,765,514 | 8/1988 | Berglund | 215/100 A X |
| 4,813,556 | 3/1989 | Lawrence | 215/100 A X |
| 4,867,325 | 9/1989 | Dransfield | 215/11.6 X |
| 4,971,211 | 11/1990 | Lake | 215/11.6 X |
| 5,207,338 | 5/1993 | Sandhu | 215/11.1 |
| 5,320,231 | 6/1994 | Iodice | 215/100 A |

*Primary Examiner*—Allan N. Shoap
*Assistant Examiner*—Christopher J. McDonald
*Attorney, Agent, or Firm*—Jacobson, Price, Holman & Stern

[57] ABSTRACT

A baby bottle usable by all-age children includes an overall elongated shape having a bottom half separated into two independent tubular contour-shaped portions which are joined together towards an upper half of the bottle. A nipple and collar can be secured to an upper half of the bottle. The independent tubular contour-shaped portions facilitate the bending of the two portions away from each other. This allows different-sized hands of children to move the two portions to allow for a gripping of at least one portion by the hand of any child. The bottle is shaped into a configuration which can be decorated to include many different animal designs or people designs. This unique shape draws the attention of a baby during feeding so as to maintain the baby in a calm state and facilitate completion of feeding.

6 Claims, 2 Drawing Sheets

BABY BOTTLE

FIELD OF THE INVENTION

This invention relates to an improvement in a baby bottle for gripping of the bottle by infants of various ages and having various size hands.

BACKGROUND OF THE INVENTION

The use of baby bottles for the feeding of infants has become very popular. The bottles are filled with a liquid with the liquid dispensed through a nipple secured on top of an open end of the bottle by a collar threadingly engaging the top of the bottle.

Bottles are usually of an elongated cylindrical configuration, typically of a four-ounce or eight-ounce capacity. These bottles are of a size, shape and weight, when full, which make them difficult for a child to grasp so that the child may hold the bottle to feed themselves. Accordingly, the assistance of an adult is usually required to feed a baby with a baby bottle.

One attempt to solve the problem of requiring the assistance of an adult in a bottle feeding is shown in U.S. Pat. No. 4,750,630 to Campbell et al. In this patent, a baby bottle is disclosed having an elongated centrally disposed opening extending through the body of the bottle and providing spaced oppositely-disposed hollow portions having a circumferential dimension small enough for being readily encircled by the hands of a baby. The hands of an infant may thereby extend through the central opening so as to grab one side portion of the bottle. A baby may thereby independently support the bottle during a feeding operation without the assistance of an adult.

One problem encountered with the use of this type of bottle is that the center longitudinally-extending hole is of a dimension unsuitable to accommodate the hands of an infant which prevents a proper use of the bottle. Therefore, there are children whose hands cannot surround a normal elongated cylindrical-type bottle and whose hands are not accommodated by a central opening of a baby bottle as disclosed in the Campbell et al. patent.

SUMMARY OF THE INVENTION

Accordingly, by the present invention, a baby bottle is designed to be usable by all-age and size children. The bottle includes an overall elongated shape having a bottom half separated into two independent tubular contour-shaped portions which are joined together towards an upper half of the bottle. A nipple and collar can be secured to an upper half of the bottle.

The independent tubular contour-shaped portions facilitate the bending of the two portions away from each other. This allows different-sized hands of children to move the two portions to allow for a gripping of at least one portion by the hand of any child.

The bottle is shaped into a configuration which can be decorated to include many different animal designs or people designs. This unique shape draws the attention of a baby during feeding so as to maintain the baby in a calm state and facilitate completion of feeding.

Further, the present invention is easier to clean than a bottle which includes a central hole. A bottle with a central hole has access to the bottom of the bottle blocked due to a bend in a path of flow in the bottle around the central opening.

Accordingly, it is an object of the present invention to provide a baby bottle having an upper half configured in the outline of an animal or person and its lower half formed in two independent tubular contour-shaped legs.

It is another object of the present invention to provide a baby bottle having an upper half configured in the outline of an animal or person and its lower half formed in two independent tubular contour-shaped legs with the bottle being made from polycarbonate and the legs being sufficiently flexible to allow various size hands between the legs of the bottle to accommodate different-age and different-size children.

It is still yet another object of the present invention to provide a baby bottle having an upper half configured in the outline of an animal or person and its lower half formed in two independent tubular contour-shaped legs with the bottle being made from polycarbonate and the legs being sufficiently flexible to allow various size hands between the legs of the bottle to accommodate different-age and different-size children with all surfaces of the interior of the bottle being accessible for ease of cleaning.

These and other objects of the invention, as well as many of the intended advantages thereof, will become more readily apparent when reference is made to the following description taken in conjunction with the accompanying drawings.

DETAILED DESCRIPTION OF THE PREFERRED EMBODIMENTS

Figure 1:
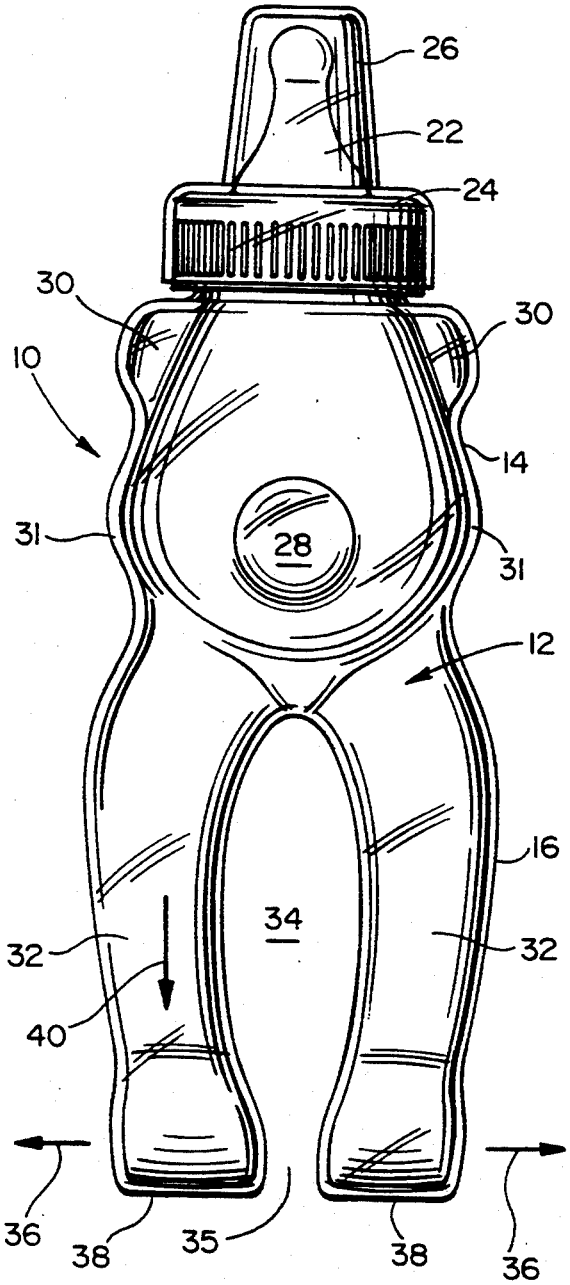
FIG. 1 is a front view of a baby bottle of the present invention with a nipple secured to the top of the bottle by a collar and the nipple and the collar being covered with a transparent cap.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 2:
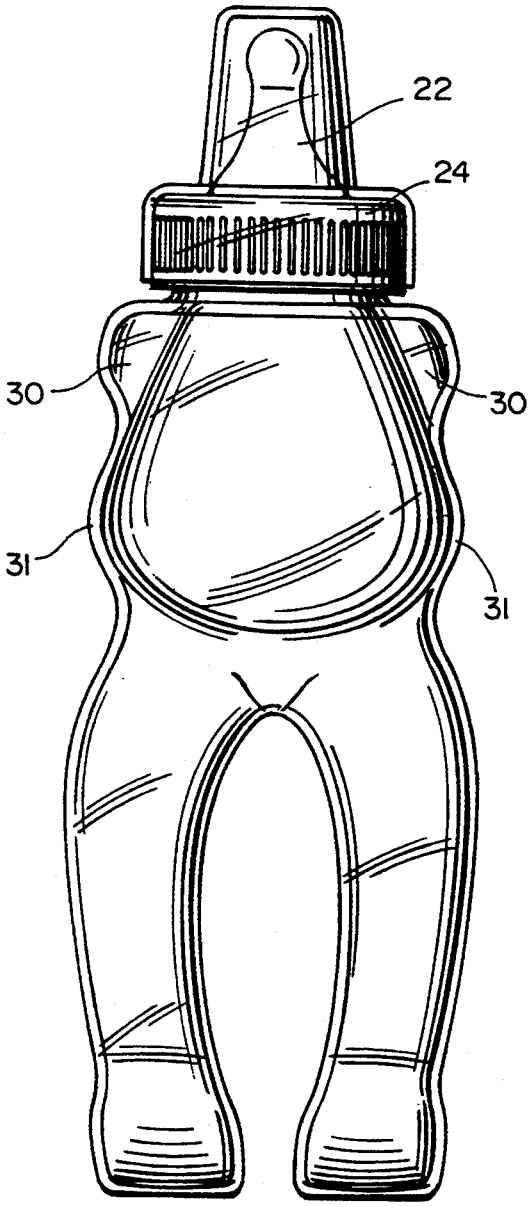
FIG. 2 is a rear view of the bottle.
Figure 3:
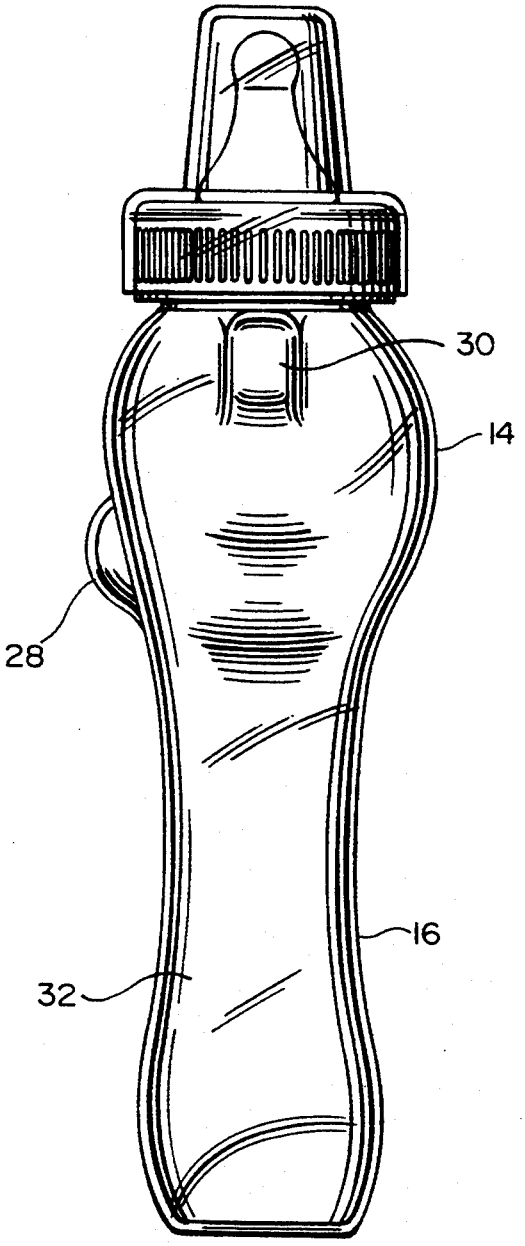
FIG. 3 is a side view of the bottle.

With reference to the drawings, in general, and to FIGS. 1 through 3, in particular, a baby bottle embodying the teachings of the subject invention is generally designated as 10. With reference to its orientation in FIG. 1, the baby bottle includes an elongated body 12 made of polycarbonate having an upper half 14 and a lower half 16.

Figure 4:
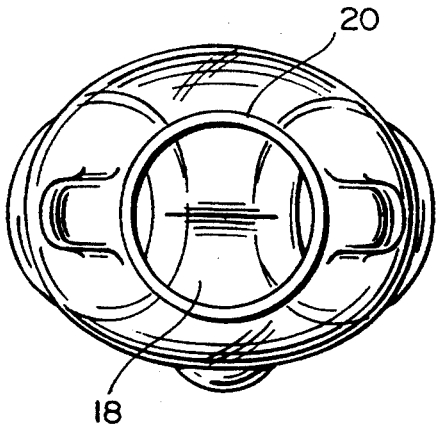
FIG. 4 is a top plan view of the bottle.
Figure 5:
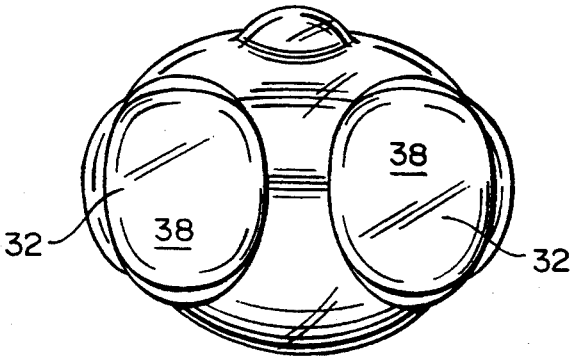
FIG. 5 is a bottom view of the bottle.

The body 12 is hollow for receipt of a liquid through a top opening 18 as shown in FIG. 4. Opening 18 includes threads 20 on an upper sidewall on top of which a nipple 22 is placed and secured in place by a collar 24 threadingly engaging the threads 20 of the opening 18. A transparent cap or nipple protector 26 is shown surrounding the nipple 22 and collar 24.

The front upper half 14 of the bottle 10 shown in FIG. 1 includes a circular projection 28 and two side projections 30. The central projection 28 can serve as a nose feature for decoration of the bottle whereas the side projections 30 can serve as ears. In addition, side portions 31 can serve as cheeks in a decoration of the bottle. Accordingly, the bottle can be decorated to illustrate a face or the appearance of a bear or other animal or even a person's face, such as a clown face, which serve as attractions to a child to maintain the attention of a child during feeding.

To accommodate the hand of a child, the lower half 16 of the bottle is separated into two independent tubular portions 32 which may depict arms or legs of a decorated bottle. Located between the two independent tubular portions 32 is an opening or gap 34 which is curved outwardly on opposite sides, as defined by the interior sides of portions 32. The opening 34 follows a curvature from adjacent to the upper half 14 which gradually diverges and increases a separation between the two portions 32 and then converges, terminating with a space 35 between the free ends of the portions 32.

The fingers of the hand of a child may be inserted into the opening 34 so as to grip one of the two independent tubular portions 32. It is understood that due to the material used in the formation of the bottle, preferably polycarbonate, that the two independent tubular portions 32 are flexible and may be moved in opposite directions such as laterally in the direction of arrows 36 as shown in FIG. 1 or frontwardly or rearwardly with respect to the upper half of the bottle 14 in a direction out of the page or into the page with reference to FIG. 1. The flexibility of the two independent tubular portions 32 allows accommodation of all-size hands of children of various sizes and ages. Further, the overall contour shape of the bottle makes it possible that once a tubular portion is held it is difficult for the tubular portion to slip from the hand of a child.

The bottom surface 38 of the two independent tubular portions 32 are closed for containing liquid within the hollow body 12. The interior side of bottom surface 38 is accessible through the opening 18 of the bottle in substantially a straight line from the opening of the bottle along the axis of arrow 40 for cleaning of all interior surfaces of the bottle including those of the tubular portions 32. The independent tubular portions 32 are also flexible in case a rigid instrument is inserted into the bottle for cleaning so that the instrument may brush all interior surfaces of the independent tubular portions 32 as well as all other interior surfaces.

Having described the invention, many modifications thereto will become apparent to those skilled in the art to which it pertains without deviation from the spirit of the invention as defined by the scope of the appended claims.

I claim:

1. A baby bottle comprising:

a hollow body having an upper portion and a lower portion, said upper portion having an opening for receipt of liquids poured into the bottle and configured for fitting of a nipple and a collar around the opening, said lower portion being divided into two tubular portions extending from said upper portion and terminating in closed free ends spaced from one another, said two tubular portions defining a gap therebetween along an entire length of said two tubular portions for insertion of a child's hand to grasp one of said two tubular portions.

2. A baby bottle as claimed in claim 1, wherein said upper portion includes a plurality of projections, simulating ears and a nose of a figure for decorating of said body.

3. A baby bottle as claimed in claim 2, wherein said plurality of projections also simulate cheeks of a figure.

4. A baby bottle as claimed in claim 1, wherein said two tubular portions are movable with respect to each other.

5. A baby bottle as claimed in claim 1, wherein said two tubular portions are curved outwardly with respect to each other.

6. A baby bottle as claimed in claim 1, wherein said upper portion is aligned with said lower portion for a straight line of access to a lowermost surface of said lower portion.

* * * * *